United States Patent [19]

Wattiez et al.

[11] 3,962,054

[45] June 8, 1976

[54] PROCESS FOR THE TREATMENT OF CELLULOSIC TEXTILE MATERIALS

[75] Inventors: Daniel Wattiez; Roger Chatelin; Paul Fabre, all of Rouen, France

[73] Assignee: Agence National de Valorisation de la Recherche (ANVAR), Neuilly-sur-Seine, France

[22] Filed: Oct. 26, 1973

[21] Appl. No.: 409,805

[30] Foreign Application Priority Data

Oct. 27, 1972 France ..... 72.38243

[52] U.S. Cl. ..... 204/159.12; 8/120; 204/160.1; 260/17 A; 260/45.95 E; 260/17.4 CL

[51] Int. Cl.² ..... C08L 1/02

[58] Field of Search ..... 204/159.12, 160.1; 8/120

[56] References Cited

UNITED STATES PATENTS

| | | | |
|---|---|---|---|
| 2,998,329 | 8/1961 | Sovish et al. | 117/93 |
| 3,254,939 | 6/1966 | Munzel | 8/116 |
| 3,616,364 | 10/1971 | D'Alelio et al. | 204/159.14 |

OTHER PUBLICATIONS

Rollins et al., Journal of App. Pol. Sci.–vol. 12 pp. 71–105 (1968).

*Primary Examiner*—Carman J. Seccuro

[57] ABSTRACT

A process for the treatment of cellulosic textile materials comprising the following successive steps: effecting grafting of the cellulose textile material with a monomer which, when formed into a polymer, has the characteristics of an elastomer at ambient temperature; effecting irradiation treatment by ionizing radiation of the grafted cellulose material so as to achieve cross-linking of the grafts formed, thus leading to permanent crease resistant properties; and effecting post-irradiation treatment by storage enabling the cross-linking to be completed.

13 Claims, No Drawings

PROCESS FOR THE TREATMENT OF CELLULOSIC TEXTILE MATERIALS

This invention concerns a process for the treatment of cellulose textile materials.

The interest which has always been displayed in cellulose textiles because of their properties of absorption and comfort justifies the privileged place which they still occupy today among textiles, despite the ease with which they become creased. Being highly appreciated because of the ease with which they can be cleaned, synthetic fibres would probably have supplanted cotton in many fields if the properties of cotton had not been continuously improved. The creasability of cellulose materials is a direct consequence of their hydrophile nature, absorbed molecules of water facilitating displacement and sliding by destroying hydrogen interactions between chains.

In order to provide a remedy, Eschalier was the first to propose in 1906, in his German Pat. No. 197,965, the creation of transverse bonds between the cellulosic macromolecules.

Subsequently, among industrial treatment processes intended to impart non-creasing properties to cellulose textile materials, most make use of polycondensable resins of the urea formaldehyde or melamine formaldehyde type, the action of which results in vitrification of the cellulose material, thus increasing the rigidity of the fabric and consequently its resistance to creasing.

Nevertheless, these processes generally increase the fragility of the treated material by limiting the possibility of deformation by the bridging of cellulose chains, and in the practical field there is observed a considerable deterioration of mechanical wearing properties, particularly tearing strength and abrasion resistance.

As the result of recent developments in methods of grafting by means of a chemical primer or of irradiation, the introduction of a material having an elastomeric character into an exclusively cellulosic fibre is industrially possible at the present time. This operation causes the appearance of new tinctorial and hydrophobic properties, while ensuring the retention of the mechanical characteristics of this fibre. It would be interesting to complete this operation by partial cross-linking of the grafts if it were desired to obtain suitable permanent crease resistant properties.

The originality of the process according to the invention therefore consists, on the one hand, of introducing by grafting into the cellulosic network a certain quantity of grafts of material having rubber-like characteristics which permit elastic deformation without however bringing about an increase of rigidity which would lead to losses of mechanical properties, and, on the other hand, of the cross-linking of the grafts by irradiation in order to obtain properties of permanent crease resistance and dimensional stability.

According therefore to the present invention there is provided a process for the treatment of cellulosic textile materials comprising the following successive steps:

a. effecting grafting of the cellulose textile material with a monomer which, when formed into a polymer, has the characteristics of an elastomer at ambient temperature;

b. effecting irradiation treatment by ionising radiation of the grafted cellulose material so as to achieve cross-linking of the grafts formed, thus leading to permanent crease resistant properties; and c. effecting post-irradiation treatment by storage enabling the cross-linking to be completed.

Optionally, after effecting the post-irradiation treatment, stabilisation treatment is effected of the product obtained.

The express "cellulosic textile materials" designates textile materials composed of cellulose fibres or of cellulose derivatives, particularly regenerated cellulose, optionally mixed with synthetic fibres. They may be in the form of fabrics, fibres in flock form, or threads.

The monomer selected should desirably be easily grafted and polymerised, and the corresponding polymer should desirably comply with very precise requirements, namely the grafts should retain their elastomeric properties within a range of temperatures corresponding to extreme ambient conditions (vitreous transition temperature $\leq -20°C$), they should be cross-linkable by irradiation, stable to aging, etc. Thus use may be made of acrylic monomers, particularly acrylonitrile, acrylic esters, and more particularly n-butylacrylate and ethyl-2-hexylacrylate, which not only comply with the requirements indicated above but, in addition, after grafting on the cellulose material, supply a certain number of other advantageous properties, among which mention may be made of:

greater resistance to stains and dirt because of the hydrophobic paraffinic character of butyl polyacrylate;

quicker drying after washing;

complete resistance to chlorine;

increased resistance to micro-organisms;

the ability to use plastosoluble dyes in addition to conventional dyes for cellulose fibres;

improved tinctorial affinity resulting from better accessibility of the fibre after grafting;

increased dimensional stability;

the ability to obtain a permanent crease after cross-linking.

Generally, for the purpose of preparing a grafted copolymer, active centres are formed on the cellulosic chain which is to be grafted (stock) and these active centres are used for initiating the polymerisation of the monomer which is to form the side chains (grafts).

The grafting may be effected with the aid of a chemical initiating agent permitting direct grafting on the cellulose. In addition, the amount of homopolymer formed is negligible when the operation is effected in the monomer vapour phase.

More particularly, use is made of the technique of grafting in the presence of ceric ions as chemical initiating agent and of a monomer in the vapour phase or liquid phase. The ceric salt is dissolved in a dilute aqueous solution of a strong mineral acid, preferably the acid corresponding to the anion of the ceric salt. The concentration of ceric salt in a solution of this kind is from 0.02 M to 0.1 M, for a concentration of mineral acid from 0.25 to 1 N. It is advantageous to use ammoniacal ceric sulphate dissolved in aqueous sulphuric acid, or ammoniacal ceric nitrate dissolved in aqueous nitric acid, with a concentration of from 0.02 M to 0.05 M of ceric salt and from 0.25 N to 0.5 N of mineral acid.

In particular, it is possible to use the technique of grafting in the presence of a monomer in the vapour phase which is described in French Pat. No. 1,487,391, or the technique of grafting in the presence of a monomer in the liquid phase which is described in French patent application No. P.V. 70 42 410 of the November 25, 1970.

In either technique the cellulosic textile material which is to be grafted is impregnated with a solution of the initiating agent, and the cellulosic material impregnated in this manner is brought into contact with the monomer in vapour form or dissolved in the solvent (which is not a solvent of the initiating agent) until the grafting ratio has been reached, after which the grafted cellulosic textile material is rinsed and optionally dried.

For the purpose of the subsequent irradiation stage the grafting rate is advantageously at least 6% and is preferably between 10 and 18%, in relation to the weight of the starting cellulosic material, the optimum rate being about 15%; above 20% no additional advantage is gained except when it is desired to obtain an improvement of hydrophobic properties, in which case the grafting rate may be as high as 30%.

It is probable that in the presence of acrylic monomer, in this particular case n-butylacrylate, the grafting is effected in accordance with the following diagram:

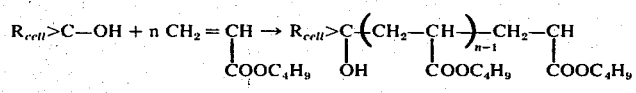

Termination may be effected either by chain fracture in the course of the reaction of the growing macroradical with the cationic oxidising agent according to (a) or else by combination of two macroradicals according to (b):

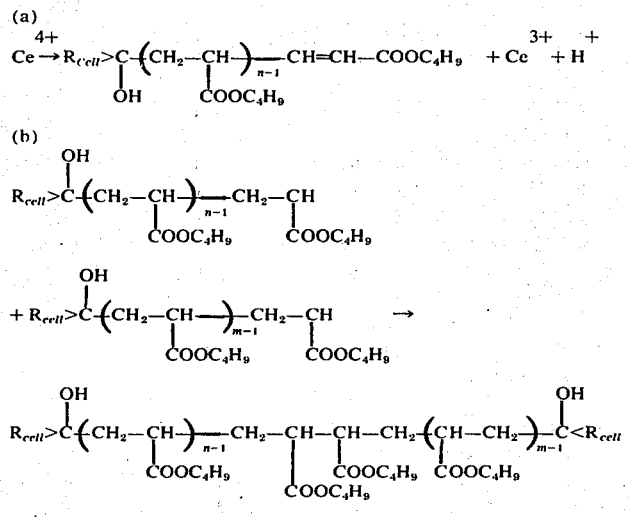

In the above formulae $R_{cell}$ represents the cellulosic chain and $n$ or $m$ is a whole number the sum of which is equal as a mean value to 50 – 120 (corresponding to a grafting ratio of 6 –20%).

In addition, the chemical grafting is followed according to the invention by irradiation treatment in order to effect good cross-linking of the grafts, in view of the fact that no chemical method permits sufficient cross-linking of the grafts.

The irradiation treatment according to the invention may be carried out indifferently by a source of gamma radiation or by a source of accelerated electrons.

For this purpose the irradiation dose must be heavy and may be as high as 10 Mrads, but it is preferably between 1 and 4 Mrads in order to provide aptitude to crease resistance while retaining mechanical utilisation properties, the optimum dose being 2 Mrads.

In a general way the action of ionising radiation in the heavy dosage indicated on the cellulosic material results in degradation by rupture of chains, the rate of degradation being dependent on the total absorbed dose and not on the type of radiation. On the other hand, on the cellulosic material which has undergone grafting by an acrylic monomer it results in cross-linking between chains, by radical recombination and bridging reaction. The presence of the acrylic polymers in the grafted cellulosic material must therefore make it possible to impart to the system, in addition to new properties proper to its nature, a remarkable consolidation of the macromolecular structure after irradiation. When the irradiation is effected under very precise conditions, the cross-linking produced achieves aptitude to permanent crease resistance.

In addition, the influence of the rest time after irradiation appears to be a very important factor in the development of aptitude to crease resistance. This property becomes optimal after a storage time between 7 and 9 days at ambient temperature. This storage time may however be as long as 14 days. Storage may be effected in the presence of ambient air, or with protection against oxygen, or in an atmosphere of nitrogen or other inert gas.

Study of the physico-mechanical properties (crease recovery notched tear strength, resistance to abrasion, and hydrophobic properties) of the samples of fabric grafted by n-butyl-polyacrylate and irradiated under determined conditions has made it possible to determine the optimum grafting ratio, the optimum irradiation dose, and the optimum post-irradiation time before stablisation.

The results are collected in Tables I, I*a*, I*b* and I*c* below.

The influence of the post-irradiation time on the evolution of crease resistance, for different grafting ratios and for the same irradiation dose of 2 Mrads, is illustrated in Table II below.

In Tables I to II and in the following, all test were made on samples after at least 24 hours conditioning at 20°C ± 1 and 65% r.h. ± 2.

CREASE RESISTANCE

Monsanto Method, standard ASTM D 295-GOT

NOTCHED TEAR STRENGTH

Standard G 07 055 on the LHOMARGY apparatus.

ABRASION RESISTANCE

Accelerator apparatus of AATCC, duration of a cycle = 1 min (1500 rpm).

| Hydrophobic properties | |
|---|---|
| SPRAY test method, standard G 07 056, numbers 0 to 5 | 0 = complete, rapid wetting (immediately)<br>1 = less rapid wetting on the entire surface<br>2 = wetting by reunion of small separate zones<br>3 = wetting in small separate zones<br>4 = no wetting, adhesion of small drops<br>5 = no wetting, no droplets |

DYNOMETRIC STRENGTH

Standard G 07 001

The invention is illustrated by the non-limitative examples given below. The general method of operation for the grafting is described below, as well as the methods of operation for the irradiation treatment.

CHEMICAL GRAFTING ACCORDING TO THE TECHNIQUE UTILISING A MONOMER IN VAPOUR PHASE.

A strip of cellulose fabric, padded in a 0.05 M solution of ammoniacal ceric salt (nitrate or sulphate) in the 0.5 N acid corresponding to the salt used, is introduced into a fluid-tight vessel of cylindrical shape. The fabric is then centrifuged to 100% (the weight ratio between the impregnated fabric and the fabric in the dry state being equal to 2).

The atmosphere inside the vessel is saturated with water vapour with the aid of wicks immersed in water tanks. A vacuum is obtained in the vessel by pumping until a vacuum of 16 mm Hg is obtained at 20°C. Pumping is then stopped and with the aid of a valve the amount of liquid monomer necessary for the desired fixation rate is introduced, without previous destabilisation. The monomer is rapidly vaporised and is consumed by the grafting reaction on the fabric.

After fixation of the monomer the fabric is than washed and rinsed to neutrality and shows a gain of weight in grafted polymer corresponding to 95% of the amount of monomer used.

CHEMICAL GRAFTING BY THE TECHNIQUE UTILISING MONOMER IN SOLUTION.

The cellulosic fabric which is to be grafted is padded in a 0.05 M solution of ammoniacal ceric salt (ceric nitrate or sulphate) in the 0.5 N acid corresponding to the salt used, and is expressed until it retains 70% of the solution (the ratio between the impregnated fabric and the dry fabric being 1.7), and it is then re-padded in a concentrated solution of the monomer which is to be fixed, in a solvent which is miscible with water, and is expressed to 150% extraction (the ratio between the weight of the wet fabric and the weight of the dry fabric being 2.5).

The monomer solvent solution is so selected that the ceric salts are not soluble in it. The fabric treated in this manner is then wound and stored with protection against air, on a horizontal rotating shaft at ambient temperature. After reaction for about one and a half hours the fabric is washed and rinsed and shows fixation of 80% of the monomer used.

After drying, fabrics treated in this manner are ready for subjection to the irradiation treatment.

IRRADIATION TREATMENT WITH IONISING RADIATION

The grafted fabric obtained in the course of the preceding treatments may be treated either by passing in superimposed layers under an electron accelerator, so as to make the best possible use of the radiated energy, or by utilising a radioactive source (for example cobalt 60) and irradiation of the fabric in the wound state.

In both cases the fabric treated by irradiation is first subjected to vacuum degasification in order to eliminate oxygen as far as possible, and is then irradiated in vacuo or in an inert gas, is wound in this atmosphere, and packed in a fluid-tight container.

CROSS-LINKING TREATMENT

The fabric is kept at ambient temperature in its container for 7 to 9 days in order to enable the cross-linking reaction to continue.

STABILISATION TREATMENT

After this storage period the fabric is treated with hydroquinone in order to destroy peroxides, hydroperoxides and free radicals which could bring about a degradation of the cellulosic material in the course of time.

Hydroquinone is advantageously added to the final dye bath.

EXAMPLE 1 a. Chemical Grafting

A piece of 100 meters of cotton poplin with a width of 1.50 meter weighing 100 grams per square meter, boiled and bleached, is padded in a 0.05 molar solution of ammoniacal ceric nitrate $(NO_3)_4$ Ce, $2NO_3NH_4$ in 0.5 normal citric acid and is centrifuged to 100% solution retention (the weight ratio between the wet extracted fabric and the dry fabric being 2), and is then introduced into a fluid-tight vessel.

The atmosphere inside the vessel is saturated with water vapour, and a vacuum is formed by applying a pump to the vessel until there is obtained a vacuum corresponding to the vapour pressure of saturating water at ambient temperature, that is to say in the case of 20° about 15 mm Hg, and pumping is then stopped.

2.4 kg stabilised n-butyl acrylate is then slowly introduced into the vessel through a valve; the monomer is rapidly vaporised and reacts on contact with the macroradicals formed on the cellulose, thus producing the grafted copolymer. Throughout the operation (about 1 hour 30 minutes) the fabric circulates in a closed loop in the vessel, at the speed of a few meters per minute, over a system of guide rollers so as to obtain homogeneous distribution of the grafting. After this reaction time, atmospheric pressure is restored in the vessel, from which the piece is taken out in the form of a roll, passed in succession through three padders containing an N/10 nitric acid solution in order to extract and recover any ceric catalyst, neutralised, washed in a machine in the open width, and dried to 6 to 20% humidity. It shows a gain of weight of 15% (that is to say a grafting ratio of 15% of butyl polyacrylate).

b. Irradiation

The piece of fabric grafted in this manner is passed into an accelerated electron irradiation installation. The fabric to be treated is mounted on a horizontal roller in a container having a rectangular opening connected in a fluid-tight manner to the irradiation installation.

A vacuum is formed in the entire installation, comprising the feed container, a degasification chamber (optionally with an infra red heating device in order to accelerate the gasification), an irradiation chamber in which the vacuum is equal to from $10^{-2}$ to $10^{-4}$ mm Hg, and an outlet lock connected to the receiver container, which is kept at the same vacuum as the irradiation chamber.

The movement of the fabric is controlled by the vacuum obtained and the speed of passage is controlled in dependence on the power of the electronic accelerator so as to supply a dose of about 2 Mrads. The speed may vary a few meters per hour to several hundred meters per minute depending on the regulation and the type and power of the accelerator. The inlet and outlet locks of the irradiation chamber make it possible for the rolls of treated fabrics to be introduced and withdrawn without having to break the vacuum in the irradiation chamber. The receiver container is isolated from the pumping action as soom as it is full of irradiated fabric, restored to atmospheric pressure by breaking the vacuum with inert gas, and passed to the storage stage.

For an electron accelerator of the type ICT 500, of 0.5 MeV (acceleration potential) and 20 mA, the speed of passage of the fabric under the irradiating beam could be 80 meters per minute for one layer of fabric, or about 5 meters per minute for 15 layers of fabric passing simultaneously under the beam (equivalent thickness of a layer: 0.010 g/cm$^2$).

With this type of accelerator it is possible to irradiate nearly 40,000 meters of fabric per day (at the rate of 8 hours operation) at the rate of 2 Mrads absorbed.

c. Cross-linking

The irradiated fabric is stored in the container for between 7 and 9 days, which is the time necessary for the appearance of good crease resistance at ambient temperature.

d. Stabilisation

Stabilisation is effected by immersing the fabric in a bath of hydroquinone at 2 grams per liter for 4 hours at 70°C, with a bath ratio of 1:30, this treatment being followed by rinsing with water and centrifuging.

The piece treated in this manner is used for making crease-resistant shirts.

The evolution of the properties of crease resistance, tear strength and abrasion resistance of the fabric in the course of the different stages of treatment is illustrated in Table III below.

EXAMPLE 2 a. Chemical grafting

A piece of 100 meters of fabric of the cotton serge type, of 250 g/sq. m, is padded in a 0.05 molar solution of ceric salt $(NO_3)_4$ Ce, $2NO_3NH_4$ in 0.5 normal nitric acid, with protection against air, and is expressed to a solution retention rate of 70% (the ratio of the weight of the wet fabric to the weight of the dry fabric being 1.7). The piece is then repadded in a 1 molar solution of ethyl-2-hexyl acrylate in a 75/25 mixture of tertiary butanol and water (the proportions of the water-butanol mixture are so selected that at ambient temperature the solution is saturated with monomer) and expressed to a rate of 150% (that is a say the ratio of the weight of the wet fabric to the weight of the dry fabric is 2.5).

The piece is then wound at the outlet of the padder, packed in a fluid-tight film of polythene, and allowed to react on a support having a horizontal axis, on which it turns at the rate of a few revolutions per minute for 4 hours.

The piece is then freed of ceric and cerous salts by passing through three successive padders containing an N/10 solution of nitric acid, then neutralised, rinsed and dried. It shows a gain of weight of 20% (grafting ratio 20%) and marked hydrophobic properties (the liquid water no longer wets the fabric and rolls over it without penetrating, although permeability to water vapour and to air is not modified).

b. Irradiation

The grafted fabric is placed in a fluid-tight container, after vacuum degasification and passing from the vacuum in an inert gas atmosphere; it is then treated by irradiation with gamma radiation with a cobalt 60 source under conditions such that the fabric receives homogeneously a dose of about 2 Mrads, the duration of the operation depending on the dose delivered by the source in relation to the geometry of the whole arrangement (particularly the arrangement of the fabric and the source).

For example, the fabric is guided on bars in such a manner as to distribute the irradiation homogeneously. A source of 6000 curies makes it possible to obtain a dose of 2 Mrads in about 7 hours.

c. Cross-linking and stabilisation

The fabric is then stored and treated in the same way as in Example 1 above. It is used for producing waterproof garments.

The evolution of the mechanical properties in the course of the various stages of the treatment is illustrated in Table IV below.

EXAMPLE 3

A 200 g/m$^2$ fabric of polyester/regenerated cellulose fibre intimately mixed in proportions of 50/50 is subjected to the operation described in Example 1. The grafting ratio is fixed at 10% n-butyl acrylate weight gain of the fabric. The resulting grafted, irradiated fabric is dyed or printed with plastosoluble colorant for polyester fibre, achieving excellent evenness. It is used for making trousers before irradiation, thus making it possible to form a permanent crease.

The evolution of the mechanical properties of the fabric in the course of the various stages of treatment is indicated in Table V below.

EXAMPLE 4

A fabric composed of linen and polyacrylic fibre intimately mixed in the proportion 50/50 is subjected to the operation described in Example 1, the grafting ratio being adjusted at 12% weight gain of acrylonitrile plus butyl acrylate (50/50 in moles).

The concentration of ammoniacal ceric nitrate initiator is here 0.025 M and the concentration of nitric acid in 0.25 N, the other conditions remaining the same.

The fabric treated in this manner is used for table linen. It can be printed or dyed with a colorant for acrylic or synthetic fibres (e.g. Lyrcamine or acetoquinone dyes).

The mechanical properties of the fabric in the course of the different stages of treatment are indicated in Table VI below.

EXAMPLE 5

A cotton fabric (200 g/m²) is subjected to the operation described in Example 2 (grafting in the liquid phase), but applying the following grafting conditions:

| | |
|---|---|
| solvent (by volume) | : ⅓ acetic acid<br>⅓ tertiary butanol<br>⅓ hexane |
| monomers | : ethyl-2-hexyl acrylate + acrylonitrile (0.5 mole/liter + 0.5 mole/liter) |
| ambient temperature<br>treatment time 2 hours<br>grafting ratio 18% | |

The fabric treated in this manner is used as tent fabric (rot-proof, hydrophobic).

The mechanical properties of the fabric obtained are illustrated in Table VII below.

EXAMPLE 6

A linen fabric of 150 g/m² is subjected to the operation described in Example 1 with a grafting ratio of 15% of n-butyl polyacrylate (concentration of ammoniacal ceric nitrate initiator 0.25 M, concentration of nitric acid 0.25 N); the treated fabric is used for lingerie, tablecloths, etc.

The mechanical properties of the fabric are indicated in Table VIII below.

As illustrated in the Examples above, the process according to the invention provides the following advantages:

1. The appearance of permanent crease resistant properties, characterised by a crease recovery angle of 135° to 140° at least, both in the warp and in the weft.
2. Preservation of mechanical wear properties, that is to say a loss of resistance to started tears lower than 10% of the original value, while on the other hand abrasion resistance is improved.
3. Improvement of tinctorial affinity for conventional dyes for cellulose materials, contrary to what is observed with the conventional use of polycondensable resins of the urea formaldehyde type, which reduce tinctorial affinity.
4. With the utilisation of paraffinic monomer, the appearance of permanent hydrophobic properties while retaining permeability to water vapour.
5. With the use of monomer of the unsaturated ester type, the possibility of dyeing with a polyester fibre dye.
6. The ability to produce made-up products with a permanent crease.
7. The ability to impart crease resistant properties to textiles produced from intimate mixtures of cellulose fibres and synthetic fibres, while permitting a single printing or dyeing of the plastosoluble type.
8. Complete resistance to chlorine.
9. Improvement of dimensional stability after grafting and irradiation.

TABLE I

Cotton fabric grafted with n-butyl polyacrylate and irradiated

| doses in Grafting ratio % | Irradiation time before megarads (in nitrogen atmosphere) | Post-irradiation Crease resistance stabilisation (in nitrogen atmosphere) | Crease resistance (warp and weft), value of remanent angle in degrees | Resistance % % referred to untreated control | Notched tears strength in kgf | referred to untreated control | Hydrophobicity (grading 0 to 5) |
|---|---|---|---|---|---|---|---|
| | 0 | 0 | 150 | 100 | 2.000 | 100 | 0–1 |
| 0% | 2 | 7 days 20°C | 139 | 94 | 1.840 | 90 | |
| | | 14 days 20°C | 140 | 94 | 1.850 | 90 | |
| | | 4 days 20°C | 150 | 102 | 1.300 | 63 | |
| | 6 | 7 days 20°C | 153 | 103 | 1.480 | 72 | 0–1 |
| | | 14 days 20°C | 140 | 94 | 1.460 | 71 | |
| 10% | 0 | 0 | 195 | 132 | 1.700 | 83 | |
| | 0 | 9 days 20°C | 203 | 137 | 1.790 | 87 | 1–2 |
| 12% | 0,5 | 9 days 20°C | 184 | 124 | 1.750 | 86 | |
| | 1 | 9 days 20°C | 197 | 119 | 1.760 | 86 | |
| | 0 | 0 | 211 | 143 | 1.700 | 83 | |
| 15% | 2 | 9 days 20°C | 254 | 172 | 1.890 | 92 | |
| | | 14 days 20°C | 205 | 139 | 1.850 | 90 | |
| | | 1 day 20°C | 190 | 128 | 1.350 | 66 | 1–2 |
| | 6 | 4 days 20°C | 220 | 149 | | | |
| | | 7 days 20°C | 253 | 171 | 1.200 | 59 | |
| | | 14 days 20°C | 221 | 150 | 1.200 | 59 | |

TABLE Ia

| Grafting ratio % | Irradiation dose in megarads | Post-irradiation time | Crease resistance (warp + weft), remanent angle in degrees | Notched tears strength in kgf | Abrasion resistance (on Stoll Flex apparatus) in cycles |
|---|---|---|---|---|---|
| | Cotton fabric grafted with n-butyl polyacrylate and irradiated | | | | |
| | Tests in ambient air | | | | |
| 0 | zero | zero | 150 | 2 | 3600 |
| 0 | 2 | 8 days at 20°C | 179 | 2.5 | 3400 |
| 15 | 2 | 8 days at 20°C | 271 | 2.3 | 5400 |
| | Test in vacuo in the presence of water vapour | | | | |
| 12 | 2 | 8 days at 20°C | 250 | 2.2 | 6300 |
| | Test in nitrogen atmosphere in the presence of water vapour | | | | |
| 15 | 2 | 8 days at 20°C | 270 | 2.5 | 6300 |
| | Test in nitrogen atmosphere, without water vapour | | | | |
| 18 | 2 | 8 days at 20°C | 250 | 1.8 | 5600 |

Notes: Considerable increase of crease resistance by grafting and irradiation, whatever the irradiation and post-irradiation conditions (in ambient air in vacuo or in an atmosphere of nitrogen with the presence or absence of water vapour); considerable increase of abrasion resistance.

TABLE 1b

| Grafting ratio | Irradiation dose in megarads | Post-irradiation time | Crease resistance (warp + weft), remanent angle in degrees | Notch tear strength, in kgf | Abrasion resistance in cycles (Stoll Flex) |
|---|---|---|---|---|---|
| | Polynosic fabric grafted with n-butyl polyacrylate and irradiated | | | | |
| | Tests in ambient air | | | | |
| 0 | 0 | 0 | 160 | 5.6 | 2500 |
| 5 | 2 | 8 days at 20°C | 300 | 3.8 | 2800 |
| | Test in vacuo, in the presene of water vapour | | | | |
| 8 | 2 | 8 days at 20°C | 280 | 4 | 3000 |
| | Test in nitrogen atmosphere, in the presence of water vapour | | | | |
| 16 | 2 | 8 days at 20°C | 280 | 4 | 4500 |
| | Tests in nitrogen atmosphere, without water vapour | | | | |
| 0 | 2 | 8 days at 20°C. | 160 | 5 | 2500 |
| 8 | 2 | 8 days at 20°C. | 270 | 4.1 | 4300 |
| 25 | 2 | 8 days at 20°C. | 280 | 2.7 | 2900 |

Notes: Increase of crease resistance by grafting and irradiation is already substantial with a grafting ratio of 5%; better mechanical strength for a moderate grafting ratio.

TABLE 1c

| Grafting ratio % | Irradiation dose in megarads | Post-irradiation time | Crease resistance (warp & weft), remanent angle in degrees | Notched tears strength in kgf | Abrasion resistance in cycles (Stoll Flex) |
|---|---|---|---|---|---|
| | Linen fabric grafted with n-butyl polyacrylate and irradiated | | | | |
| | Tests in nitrogen atmosphere in the presence of water vapour | | | | |
| 0 | 0 | 0 | 60 | 6.7 | 2000 |
| 0 | 2 | 8 days at 20°C | 110 | 5.9 | 1900 |
| 12 | 2 | 8 days at 20°C | 140 | 6.3 | 4400 |

Notes: Considerable increase of crease resistance and abrasion resistance (more than double) by grafting and irradiation.

TABLE II

| Grafting ratio, % | Post-irradiation time, in days | Crease resistance, in degrees | Tear strength (warp & weft), in kgf |
|---|---|---|---|
| | Cotton fabric grafted with n-butyl polyacrylate and irradiated | | |
| 0% (0 Mrad) | 0 | 140 | 2.000 |
| 12% (2 Mrads) | 1 | 215 | 1.800 |
| | 4 | 229 | 1.780 |
| | 8 | 261 | 1.760 |

TABLE II-continued

| Grafting ratio, % | Post-irradiation time, in days | Crease resistance, in degrees | Tear strength (warp & weft), in kgf |
|---|---|---|---|
| | Cotton fabric grafted with n-butyl polyacrylate and irradiated | | |
| | 14 | 220 | 1.720 |
| 15% (2 Mrads) | 1 | 208 | 1.880 |
| | 4 | 230 | 1.900 |
| | 8 | 268 | 1.890 |
| | 14 | 205 | 1.850 |

TABLE III

| Fabric 100,g/m² (shirts) | Crease resistance remanent angle in degrees (total warp and weft) | Tear strength in kgf (total warp and weft) | Abrasion resistance (duration of cycle in minutes) | Remarks |
|---|---|---|---|---|
| Fabric original tension | 140 | 2.000 | 18 | |
| Fabric grafted with 15% butyl poly-acrylate | 198 | 1.850 | 28 | Slight improvement of crease resistance; substantial increase of abrasion resistance. |
| Fabric grafted with 15% butyl acrylate, irradiated with a dose of 2 Mrads and cross-linked for 8 days at ambient temperature in an atmosphere of nitrogen | 260 | 1,890 | 24 | Marked improvement of crease resistance as compared with grafted fabric |

TABLE IV

| Serge fabric (250 g/m²) | Crease resistance remanet angle in degrees (total warp and weft) | Tear strength (kgf) | Hydrophobicity (numbers 0 to 5) | Remarks |
|---|---|---|---|---|
| Control | 115 | 9.6 | 0 | |
| Fabric grafted with 20% ethyl-2-hexyl poly-acrylate | 213 | 9.0 | 4–5 | Considerable increase of hydrophobicity |
| Fabric grafted with 20% ethyl-2-hexyl polyacrylate and irradiated at 2.2 Mrads, 8 days at 20°C in nitrogen | 270 | 8.8 | 4–5 | |

TABLE V

| 50/50 polyester/regenerated fiber fabric | Crease resistance (remanent angle in degrees) | Permanent crease | Notched tears strength in kgf (warp + weft) | Abrasion resistance, in minutes |
|---|---|---|---|---|
| Control fabric | 210 | Eliminated after 1 washing cycle | 9.8 | 15 |
| Fabric grafted with 10% butyl polyacrylate | 235 | Eliminated after 1 washing cycle | 9.7 | 29 |
| Fabric grafted and irradiated at 2 Mrads 8 days at 20°C in nitrogen atmosphere | 275 | Still pronounced, even after 10 washing cycles | 9.0 | 23 |

TABLE VI

| 50/50 linen/ acrylic fabric | Crease resistance (remanent angle in degrees) | Tear strength (warp + weft in kgf) | Plastosoluble colorant or dye (aceto-quinone blue) |
|---|---|---|---|
| Control fabric | 197 | 6.3 | Only acrylic fibres are dyed |
| Fabric grafted with 12% butyl polyacrylate + polyacrylonitrile | 219 | 5.9 | Very good evenness of the whole product |
| Fabric grafted and irradiated at 2.5 Mrads, 7 days at ambient temperature | 258 | 5.8 | Very good evenness |

TABLE VII

| 200 g/m² fabric | Crease resistance (warp + weft) | | Tear strength (warp 30 weft) in kfg | | Hydrophobicity (rating 0 to 5) | |
|---|---|---|---|---|---|---|
| | 0 day | After 28 days soil burial* | 0 day | After 28 days soil burial* | 0 day | 28 days |
| Original control fabric | 150 | 130 | 5.2 | 1.8 | 0 | 0 |
| Fabric grafted at 18% | 205 | 203 | 5.3 | 5.0 | 4–5 | 4–5 |
| Fabric grafted and irradiated at about 2 Mrads, 9 days at ambient temperature | 250 | 244 | 5.0 | 4.7 | 4–5 | 4–5 |

*Antimycotic (anti-mould) resistance test by burial for 28 days in the ground.

TABLE VIII

| Fabric: linen | Crease resistance (warp + weft) | Tear strength in kgf (warp + weft) | Remarks |
|---|---|---|---|
| Control | 75° | 7.3 | |
| Fabric grafted at 15% | 130° | 7.0 | |
| Fabric grafted and irradiated at 2 Mrads, 8 days at ambient temperature in atmosphere of nitrogen | 232° | 6.5 | Very great improvement of crease resistance |

We claim:

1. A process for the treatment of cellulosic textile materials comprising the following successive steps:

a. grafting the cellulose textile material with an acrylic acid ester monomer or a mixture thereof with a comonomer copolymerizable therewith in the presence of a chemical initiator agent, with a grafting ratio of a least 6% in relation to the weight of the starting cellulose material;

b. effecting irradiation treatment by ionising radiation of the grafted cellulose material obtained in the preceding stage with an irradiation dose of from 0.5 Mrads to 10 mards; and c. effecting post-irradiation treatment by storage of the irradiated product for a period of from 1 day to 14 days at ambient temperature.

2. A process according to claim 1 in which, after effecting the post-irradiation treatment, stabilisation treatment is effected of the irradiated and stored product.

3. A process as claimed in claim 1 in which the said grafting ratio is between 10% and 18%.

4. A process according to claim 1 in which the irradiation dose is between 1 and 4 Mrads.

5. A process as claimed in claim 1 in which the said storage is for a period of 7 to 9 days.

6. A process according to claim 1 in which the acrylic acid ester monomer is in admixture with a comonomer copolymerizable therewith.

7. A process according to claim 6 in which the comonomer is acrylonitrile.

8. A process according to claim 1 in which the acrylic acid ester monomer is at least one compound selected from the group consisting of n-butyl acrylate and ethyl-2-hexyl acrylate with acrylonitrile.

9. A process according to claim 1 in which the grafting is effected in the presence of ceric ions as the chemical initiator agent and with the monomer which is to be grafted in the vapour or liquid phase.

10. A process according to claim 9 in which the cellulose material which is to be grafted is impregnated with an ammoniacal ceric salt, with a concentration of from 0.02 M to 0.1 M, dissolved in a dilute aqueous solution of the acid corresponding to the anion of the ceric salt, with a concentration of from 0.25 to 1 N, the impregnated cellulose material is squeezed out to a retention of 70 to 100%, and it is contacted with the monomer in the form of the vapour or dissolved in a solvent until the desired grafting ratio is achieved, after which it is rinsed.

11. A process according to claim 1 in which the irradiation treatment is effected in the presence of a source of gamma radiation or of accelerated electrons.

12. A process according to claim 2 in which the stabilisation treatment is effected with the aid of hydroquinone.

13. A process according to claim 12 in which the hydroquinone is added to a dye bath.

* * * * *